US006202705B1

(12) United States Patent
Johnson et al.

(10) Patent No.: US 6,202,705 B1
(45) Date of Patent: Mar. 20, 2001

(54) WARP-TIED COMPOSITE FORMING FABRIC

(75) Inventors: Dale B. Johnson, Ottawa; Ronald H. Seabrook, Stittsville; Richard Stone, Carleton Place; Roger Danby, Arnprior, all of (CA)

(73) Assignee: AstenJohnson, Inc., Nepean (CA)

( * ) Notice: Subject to any disclaimer, the term of this patent is extended or adjusted under 35 U.S.C. 154(b) by 0 days.

(21) Appl. No.: 09/315,015

(22) Filed: May 20, 1999

(30) Foreign Application Priority Data

May 23, 1998 (GB) ..... 9811089

(51) Int. Cl.[7] ..... D03D 23/00
(52) U.S. Cl. ..... 139/383 A; 139/383 R
(58) Field of Search ..... 139/383 A, 383 R; 162/903; 442/203

(56) References Cited

U.S. PATENT DOCUMENTS

| | | |
|---|---|---|
| 4,423,755 | 1/1984 | Thompson . |
| 4,501,303 | 2/1985 | Osterberg . |
| 4,515,853 | 5/1985 | Borel . |
| 4,605,585 | 8/1986 | Johansson . |
| 4,729,412 | 3/1988 | Bugge . |
| 4,739,803 | 4/1988 | Borel . |
| 4,815,499 | 3/1989 | Johnson . |
| 4,945,952 | 8/1990 | Vohringer, I . |
| 4,967,805 | 11/1990 | Chiu et al. . |
| 4,974,642 | 12/1990 | Taipale . |
| 4,987,929 | 1/1991 | Wilson, I . |
| 5,052,448 | 10/1991 | Givin . |
| 5,092,372 | 3/1992 | Fitzka et al. . |

(List continued on next page.)

FOREIGN PATENT DOCUMENTS

| | | |
|---|---|---|
| 1115117 | 12/1981 | (CA) . |
| 37 42 101 | 6/1989 | (DE) . |
| 0 837 179 | 4/1998 | (EP) . |

*Primary Examiner*—John J. Calvert
*Assistant Examiner*—Robert A. Muromoto, Jr.
(74) *Attorney, Agent, or Firm*—Robert A. Wilkes

(57) ABSTRACT

A composite forming fabric, comprising in combination a paper side layer having a paper side surface, a machine side layer and paper side layer intrinsic warp binder yarns. Each of the paper side layer and the machine side layer are woven together in a repeating pattern, and the two layers together are woven in at least 6 sheds, and up to at least 36 sheds can be used. All of the paper side layer warp yarns are provided by pairs of intrinsic warp binder yarns. The paper side layer weave pattern provides an unbroken warp path in the paper side surface including at least two segments, occupied in turn by each intrinsic binder yarn; the segments are separated by at least one paper side layer weft. Within each segment, each intrinsic binder yarn also interlaces once with a machine side layer weft, at the same point as a machine side layer warp interlaces with the same weft. The weave path occupied by each member of a pair of intrinsic warp binder yarns can be the same or different. The segment lengths can be the same or different, and the machine side layer interlacing points can be regularly or irregularly spaced apart. The fabrics as woven and before heat setting conveniently have a warp fill of from about 100% to about 125%. After heat setting, the fabrics typically have a warp fill from about 110% to about 140%, an open area of about 35% or more in the paper side face of the paper side layer, and an air permeability that is typically from about 3,500 to about 8,200 $m^3/m^2/hr$. The fabrics are thus particularly suitable for the formation of paper products having very low micro density differences, which provides enhanced printability.

24 Claims, 6 Drawing Sheets

U.S. PATENT DOCUMENTS

| | | |
|---|---|---|
| 5,152,326 | 10/1992 | Vohringer, II . |
| 5,158,117 | 10/1992 | Huhtiniemi . |
| 5,219,004 | 6/1993 | Chiu, I . |
| 5,379,808 | 1/1995 | Chiu, II . |
| 5,454,405 | 10/1995 | Hawes . |
| 5,482,567 | 1/1996 | Barreto . |
| 5,518,042 | 5/1996 | Wilson, II . |
| 5,544,678 | 8/1996 | Barrett . |
| 5,564,475 | 10/1996 | Wright . |
| 5,709,250 | 1/1998 | Ward et al. . |
| 5,713,398 | 2/1998 | Josef . |
| 5,826,627 | 10/1998 | Seabrook et al. . |
| 5,881,764 | 3/1999 | Ward . |

WARP-TIED COMPOSITE FORMING FABRIC

FIELD OF THE INVENTION

The present invention relates to woven composite forming fabrics for use in papermaking machines. The term "composite forming fabric" refers to a forming fabric comprising two woven structures, one of which is the paper side layer and the other of which is the machine side layer. Each of these layers is woven to a repeating pattern, and the two patterns used may be substantially the same or they may be different; at least one of the patterns includes the provision of binder yarns which serve to hold the two layers together. As used herein, such fabrics are distinct from those described, for example, by Johnson in U.S. Pat. No. 4,815,499 or Barrett in U.S. Pat. No. 5,544,678, which require separate binder yarns, in particular weft yarns, to interconnect the paper and machine side layers. In the composite forming fabrics of this invention, the paper side layer and the machine side layer are each woven to different, but related, weave patterns, and are interconnected by means of the paper side layer warp yarns.

BACKGROUND OF THE INVENTION

In composite forming fabrics that include two essentially separate woven structures, the paper side layer is typically a single layer woven structure which provides, amongst other things, a minimum of fabric mark to, and adequate drainage of liquid from, the incipient paper web. The paper side layer should also provide maximum support for the fibers and other paper forming solids in the paper slurry. The machine side layer is also typically a single layer woven structure, which should be tough and durable, provide a measure of dimensional stability to the composite forming fabric so as to minimize fabric stretching and narrowing, and sufficiently stiff to minimize curling at the fabric edges. It is also known to use double layer woven structures for either or both of the paper and machine side layers.

The two layers of a composite forming fabric are interconnected by means of either additional binder yarns, or intrinsic binder yarns. The chosen yarns may be either warp or weft yarns. The paths of the yarns are arranged so that the selected yarns pass through both layers, thereby interconnecting them into a single composite fabric. Examples of prior art composite forming fabrics woven using intrinsic binder warp or weft yarns are described by Osterberg, U.S. Pat. No. 4,501,303; Bugge, U.S. Pat. No. 4,729,412; Chiu, U.S. Pat. No. 4,967,805, U.S. Pat. No. 5,219,004 and U.S. Pat. No. 5,379,808; Givin, U.S. Pat. No. 5,052,448; Wilson, U.S. Pat. No. 4,987,929 and U.S. Pat. No. 5,518,042; Ward et al, U.S. Pat. No. 5,709,250; Vohringer, U.S. Pat. No. 5,152,326; Johansson, U.S. Pat. No. 4,605,585; Hawes, U.S. Pat. No. 5,454,405; Wright, U.S. Pat. No. 5,564,475; and Seabrook et al, EP 0 794 283. A major difference between intrinsic binder yarns and additional binder yarns is that additional binder yarns do not contribute significantly to the fundamental weave structure of the paper side surface of the paper side layer, and serve mainly to bind the two layers together. Additional binder yarns have been generally preferred over intrinsic binder yarns for commercial manufacture of composite forming fabrics because they were thought to be less likely to cause discontinuities, such as dimples, in the surface of paper side layer. Examples of prior art fabrics woven using additional binder yarns are described by Johansson et al., CA 1,115,177; Borel, U.S. Pat. No. 4,515,853; Vohringer, DE 3,742,101 and U.S. Pat. No. 4,945,952; Fitzka et al, U.S. Pat. No. 5,092,372; Taipale, U.S. Pat. No. 4,974,642; Huhtiniemi, U.S. Pat. No. 5,158,117; and Barreto, U.S. Pat. No. 5,482,567.

In composite forming fabrics where intrinsic warp binder yarns from the machine side layer have been used to interconnect the paper and machine side layers, the prior art has generally advocated modifying the path of the selected machine side layer warps so as to bring these yarns up to the paper side layer to interlace with it at selected weft knuckles. A known disadvantage associated with this practice is that the area immediately adjacent these tie locations tends to become pulled down into the fabric structure, well below the plane of the adjacent knuckles, causing a deviation in the paper side surface of the paper side layer, commonly referred to as a "dimple". These dimples frequently create a pronounced unevenness in the paper side surface of the fabric, which can result in an unacceptable mark in any paper formed on the fabric.

In comparison, intrinsic weft binder yarns have been found to cause less paper side surface dimpling, and hence have been a preferred method of interconnecting the layers of composite forming fabrics. However, there are a number of problems associated with their use.

First, intrinsic weft binder yarns have been found to cause variations in the cross-machine direction mesh uniformity of the paper side surface of the paper side layer in certain weave patterns. This can create an unacceptable level of marking in some grades of paper.

Second, fabrics woven using intrinsic weft binder yarns are known to be susceptible to lateral contraction, or narrowing, when in use. Lateral contraction may be defined as the degree to which a fabric narrows when machine direction (or longitudinal) tension is applied. If the fabric narrows excessively under this tension, particularly at driven rolls in the forming section, the resulting width changes will cause the fabric to buckle or form ridges. Generally, single layer fabrics, and composite fabrics having additional or intrinsic weft binder yarns, exhibit much higher degrees of lateral contraction than either double layer, or extra-support double layer, fabrics of comparable mesh.

Third, composite forming fabrics containing intrinsic weft binder yarns are less efficient to weave than comparable intrinsic warp binder designs, because a greater number of weft yarns is required to provide a reliable interconnection between the paper side layer and the machine side layer. Comparable fabrics whose designs utilize intrinsic warp binder yarns require fewer weft yarns per unit length, since none of the weft yarns is utilized to interconnect the paper and machine side layers. For example, a fabric containing intrinsic warp binder yarns whose paper side layer is woven so as to provide 31.5 weft yarns/cm, and 15.75 weft yarns/cm on its machine side layer (resulting in a 2:1 ratio of the paper side layer to machine side layer weft yarn count), has a total weft yarn count of 47.25 yarns/cm. A comparable intrinsic weft binder yarn fabric, woven at 31.5 weft yarns/cm in its paper side layer and which employs additional weft yarns to interconnect the layers, has a total weft yarn count of between 55 to 63 weft yarns/cm, depending on the paper side layer to machine side layer weft yarn ratio, because additional weft yarns must be provided so as to tie the two layers together. A comparable fabric utilizing intrinsic warp binder yarns requires up to 25% fewer weft yarns to weave each unit length.

Fourth, a fabric utilizing intrinsic warp binder yarns will generally have a lower caliper (and thus be thinner and provide a lower void volume) than a comparable fabric of similar specification utilizing intrinsic weft binder yarns. Because there are fewer weft yarns per unit length, those remaining do not contribute as much to the thickness of the fabric.

A benefit provided by composite fabrics utilizing intrinsic warp binder yarns is their increased resistance to delamination, when compared to a composite fabric utilizing either additional or intrinsic weft binder yarns. Delamination, which is the catastrophic separation of the machine and paper side layers, is generally caused by one of two mechanisms. The first is abrasion of the binder yarn where it is exposed on the machine side of the fabric as it passes in sliding contact over the various stationary elements in the forming section. In composite fabrics utilizing intrinsic warp binder yarns, it is possible to recess the warp binder yarns relative to the wear plane of the fabric to a greater degree (e.g. by as much as 0.05–0.076 mm) further away from the wear plane than is possible in a comparable fabric utilizing intrinsic weft binder yarns. This means that more machine side layer warp and weft yarn material must be abraded away from the running side of a fabric utilizing intrinsic warp binder yarns before the tie strands are broken, and the two layers delaminate, than in a comparable fabric utilizing intrinsic weft binder yarns.

The second delamination mechanism, which is encountered more rarely than the first, is that of internal abrasion of the binder yarns between the machine and paper side layers as they flex or shift relative to one another. The presence of abrasive fillers in the stock, such as clay, titanium dioxide and calcium carbonate greatly exacerbates the rate of this type of abrasion. Composite forming fabrics whose paper and machine layers are well interlaced so as to prevent or reduce relative movement of these layers (such as in the fabrics of the present invention utilizing intrinsic warp binder yarns) will experience less internal abrasion than comparable fabrics utilizing intrinsic weft binder yarns. They are therefore less susceptible to delamination by internal abrasion.

Accordingly, the present invention seeks to provide a composite forming fabric whose construction is intended at least to ameliorate the aforementioned problems of the prior art.

The present invention further seeks to provide a composite forming fabric having reduced susceptibility to cross-machine direction variations in the paper side layer mesh uniformity than comparable fabrics of the prior art.

Additionally, this invention seeks to provide a composite forming fabric that is resistant to lateral contraction.

This invention also seeks to provide a composite forming fabric that is more efficient to weave than comparable fabrics utilizing intrinsic weft binder yarns to interconnect the paper and machine side layer woven structures.

Furthermore, this invention seeks to provide a composite forming fabric that is less susceptible to dimpling of the paper side surface.

In a preferred embodiment, this invention seeks to provide a composite forming fabric having a lower void volume than a comparable forming fabric utilizing intrinsic weft binder yarns.

This invention additionally seeks to provide a composite forming fabric that is resistant to delamination.

SUMMARY OF THE INVENTION

In a first broad embodiment the present invention seeks to provide a composite forming fabric comprising in combination a paper side layer having a paper side surface, a machine side layer, and paper side layer intrinsic warp binder yarns which bind together the paper side layer and the machine side layer, wherein:

(i) the paper side layer and the machine side layer each comprise warp yarns and weft yarns woven together in a repeating pattern, and the paper side layer and the machine side layer together are woven in at least 6 sheds;

(ii) in the paper side layer all of the warp yarns comprise pairs of intrinsic warp binder yarns;

(iii) in the paper side surface of the paper side layer the repeating pattern provides an unbroken warp yarn path in which the paper side layer warp yarn floats over 1, 2 or 3 consecutive paper side layer weft yarns;

(iv) each of the pairs of intrinsic warp binder yarns occupy the unbroken warp path in the paper side layer;

(v) the ratio of paper side layer weft yarns to machine side layer weft yarns is chosen from 1:1, 2:1, 3:2, and 3:1; and (vi) the ratio of paper side layer warp yarns to machine side layer warp yarns is chosen from 1:1 to 3:1;

and wherein the pairs of intrinsic warp binder yarns comprising all of the paper side layer warp yarns are woven such that:

(a) in a first segment of the unbroken warp path:
  (1) the first member of the pair interweaves with a first group of paper side layer wefts to occupy a first part of the unbroken warp path in the paper side surface of the paper side layer;
  (2) the first member of the pair floats over 1, 2 or 3 consecutive paper side layer weft yarns; and
  (3) the second member of the pair interlaces with one weft yarn in the machine side layer beside a machine side layer warp yarn that interlaces with the same machine side layer weft yarn;

(b) in an immediately following second segment of the unbroken warp path:
  (1) the second member of the pair interweaves with a second group of paper side layer wefts to occupy a second part of the unbroken warp path in the paper side surface of the paper side layer;
  (2) the second member of the pair floats over 1, 2 or 3 consecutive paper side layer weft yarns; and
  (3) the first member of the pair interlaces with one weft yarn in the machine side layer beside a machine side layer warp yarn that interlaces with the same machine side layer weft yarn;

(c) the first and second segments are of equal or unequal length;

(d) the unbroken warp path in the paper side surface of the paper side layer occupied in turn by the first and the second member of each pair of intrinsic warp binder yarns in the paper side layer has a single repeat pattern;

(e) in the unbroken warp path in the paper side surface of the paper side layer occupied in turn by the first and second members of each pair of intrinsic warp binder yarns, each succeeding segment is separated in the paper side surface of the paper side layer by at least one paper side layer weft yarn;

(f) in the paper side layer the unbroken warp path includes at least two segments; and (g) in the composite fabric the weave pattern of the first member of a pair of intrinsic warp binder yarns is the same, or different, to the weave pattern of the second member of the pair.

In a preferred embodiment of this invention, the fabric as woven and prior to heat setting has a warp fill of from 100% to 125%.

In further preferred embodiments of this invention, the fabric after heat setting has a paper side layer having an open area, when measured by a standard test procedure, of at least 35%, the fabric has a warp fill of from 110% to 140%, and the fabric has an air permeability, when measured by a standard test procedure, of less than about 8,200 $m^3/m^2/hr$, at a pressure differential of 127 Pa through the fabric. An appropriate test procedure for determining fabric air permeability is ASTM D 737-96.

It is a requirement of this invention that every paper side layer warp yarn comprises a pair of intrinsic warp binder yarns; each member of each pair alternately forms a portion of the unbroken warp path in the paper side surface weave pattern. Within each repeat of the composite fabric overall weave pattern, each paper side layer intrinsic warp binder yarn passes into the machine side layer to interlace at least once with a machine side layer weft, or wefts, so as to bind the paper side layer and the machine side layer together into a coherent composite fabric. The location at which each paper side layer intrinsic warp binder yarn interlaces with one machine side layer weft yarn is chosen to coincide with a knuckle formed by the interlacing of a machine side layer warp yarn with a machine side layer weft yarn. If each paper side layer warp yarn passes beneath two separate machine side layer weft yarns which are located at different points in the weave pattern of the machine side layer, then all of the interlacing points are chosen to coincide with separate knuckles formed by the interlacing of the machine side layer weft yarns with the machine side layer warp yarns. In a preferred embodiment, within each repeat of the composite fabric weave pattern, at every machine side weft knuckle two warp yarns interlace with the machine side layer weft; one is a machine side layer warp, and the other is a paper side layer intrinsic warp binder yarn. It can thus be seen that in the fabrics of this invention the paper side layer does not contain any conventional warp yarns which interlace only with paper side layer weft yarns. All of the paper side layer warp yarns are provided by the pairs of paper side layer intrinsic warp binder yarns, which, in addition to occupying the unbroken warp path in the paper side surface of the paper side layer also bind the paper side layer and the machine side layer together.

Preferably, in the unbroken warp path in the paper side layer each segment occurs once within each complete repeat of the composite forming fabric weave pattern.

Alternatively, in the unbroken warp path in the paper side layer each segment occurs more than once, for example twice, within each complete repeat of the composite forming fabric weave pattern.

Preferably, each segment in the unbroken warp path in the paper side surface of the paper side layer is separated from the next segment by either 1, 2 or 3 paper side layer weft yarns. Preferably, the segments are separated by one paper side layer weft yarn. Alternatively, the segments are separated by two paper side layer weft yarns.

Preferably, within the paper side layer weave pattern, the segment lengths of the paths of each of a pair of intrinsic warp binder yarns occupying the unbroken warp path are identical. Alternatively, within the paper side layer weave pattern, the segment lengths of the paths of each of a pair of intrinsic warp binder yarns occupying the unbroken warp path are not identical.

Preferably, within the composite fabric weave pattern the paths occupied by each of a pair of paper side layer intrinsic warp binder yarns are the same, and the interlacing points between the intrinsic warp binder yarns with the machine side layer wefts are regularly spaced, and are the same distance apart. Alternatively, within the composite fabric weave pattern the paths occupied by each of a pair of paper side layer intrinsic warp binder yarns are not the same, and the interlacing points between the intrinsic warp binder yarns with the machine side layer wefts are not regularly spaced, and are not the same distance apart.

Preferably, within the composite fabric the weave design is chosen such that:

(1) the segment lengths in the paper side layer are the same, and the interlacing points between the intrinsic warp binder yarns with the machine side layer wefts are regularly spaced; or (2) the segment lengths in the paper side layer are the same, and the interlacing points between the intrinsic warp binder yarns with the machine side layer wefts are not regularly spaced, and are not the same distance apart; or (3) the segment lengths in the paper side layer are not the same, and the interlacing points between the intrinsic warp binder yarns with the machine side layer wefts are not regularly spaced, and are not the same distance apart.

Preferably, the paper side layer weave pattern is chosen from a plain 1×1 weave; a 1×2 weave; a 1×3 weave; a 1×4 weave; a 2×2 basket weave; a 3×6 weave; a 4×8 weave; a 5×10 weave; or a 6×12 weave. Preferably, the weave design of the machine side layer is an N×2N design such as is disclosed by Barrett in U.S. Pat. No. 5,544,678. Alternatively, the paper side layer may be combined with a machine side layer woven according to a satin or twill design.

Preferably, the ratio of the number of paper side layer weft yarns to machine side layer weft yarns in the composite forming fabric is chosen from 1:1, 2:1, 3:2 or 3:1.

Preferably, the ratio of paper side layer warp yarns to machine side layer warp yarns is either 1:1, 2:1 or 3:1, allowing for the fact that each intrinsic warp binder pair equates to a single paper side layer warp yarn. More preferably, the ratio is 1:1.

A composite forming fabric woven according to this invention will be woven to a pattern requiring from at least 6 sheds, and up to at least as many as 36 sheds. The number of sheds required to weave the composite fabric is equal to the number of sheds required to weave each of the paper side layer and the machine side layer designs within the overall pattern repeat of the composite fabric.

Generally, the number of sheds required for the paper side layer weave pattern will be an integral multiple of the number of sheds required to weave the machine side layer. The value of the multiplier will be dependant upon the ratio of the number of paper side layer warps to machine side layer warps in the composite fabric. Weave patterns in which the number of sheds required to weave both layers is the same are not preferred: for example, a paper side layer woven in 6 sheds as a 1×2 weave, and a machine side layer woven in 6 sheds as a 6×12 weave. It is preferred that the number of sheds required to weave the paper side layer pattern is at least twice, and can be four times or six times or even more, the number of sheds required to weave the machine side layer pattern.

The following Table summarizes some of the possible paper side layer and machine side layer weave pattern combinations, together with the shed requirements for each.

TABLE 1

| PSL Weave | PSL Sheds, A | MSL Weave | MSL Sheds, B | Total Sheds | Ratio A:B |
|---|---|---|---|---|---|
| 1 × 1 | 12 | 6 × 12 | 12 | 24 | 1:1 |
| 1 × 2 | 6 | 6 × 12 | 6 | 12 | 1:1 |
| 1 × 1 | 4 | 1 × 1 | 2 | 6 | 2:1 |
| 1 × 1 | 12 | 6 × 12 | 6 | 18 | 2:1 |
| 1 × 2 | 6 | 1 × 2 | 3 | 9 | 2:1 |
| 1 × 2 | 12 | 6 × 12 | 6 | 18 | 2:1 |
| 3 × 6 | 6 | 1 × 2 | 3 | 9 | 2:1 |
| 3 × 6 | 12 | 6 × 12 | 6 | 18 | 2:1 |
| 4 × 8 | 8 | 1 × 3 | 4 | 12 | 2:1 |
| 4 × 8 | 8 | 4 × 8 | 4 | 12 | 2:1 |
| 4 × 8 | 16 | 1 × 3 | 8 | 24 | 2:1 |
| 4 × 8 | 16 | 4 × 8 | 8 | 24 | 2:1 |
| 1 × 1 | 20 | 5 × 5 | 5 | 25 | 4:1 |
| 3 × 6 | 12 | 1 × 2 | 3 | 15 | 4:1 |
| 4 × 8 | 16 | 1 × 3 | 4 | 20 | 4:1 |
| 4 × 8 | 16 | 4 × 8 | 4 | 20 | 4:1 |

In the headings to Table 1, "PSL" indicates paper side layer, and "MSL" indicates machine side layer.

Because all of intrinsic paper side layer binder yarns making up the paper side layer warp yarns are utilized to interlace with machine side layer weft yarns, this interlacing pattern improves fabric modulus, thus making the composite fabric more resistant to stretching and distortion, while reducing fabric lateral contraction and propensity of fabric layer delamination.

An important distinction between prior art fabrics and those of the present invention is the total warp fill, which is given by warp fill=(warp diameter×mesh×100)%. The warp fill can be determined either before or after heat setting, and, for the same fabric, is generally somewhat higher after heat setting. In all prior art composite fabrics, prior to heat setting, the sum of the warp fill in the paper side and machine side layers combined is typically less than 95%. The fabrics of this invention prior to heat setting have a total warp fill that preferably is greater than 100%, and is typically from 110%–125%. After heat setting, the fabrics of this invention have a total warp fill that preferably is greater than 110%, and is typically 115%–140%. This makes them unique. Another difference, associated with this level of warp fill, is that the mesh count of the paper side layer of the fabrics of this invention is at least twice that of the machine side layer. For example, one fabric of this invention woven using 0.13 mm warp yarns to provide a paper side layer mesh of 52 yarns/cm, and 0.21 mm warp yarns to provide a machine side layer mesh 26 yarns/cm, for a total of 78 yarn/cm in the heat set fabric, and has a total warp fill of 135% after heat setting.

In the context of this invention certain definitions are important.

The term "unbroken warp path" refers to the path in the paper side layer, which is visible on the paper side surface of the fabric, of the pairs of intrinsic warp yarns comprising all of the paper side layer warp yarns, and which is occupied in turn by each member of the pairs making up the intrinsic warp binder yarns.

The term "segment" refers to the portion of the unbroken warp path occupied by a specific intrinsic warp binder yarn, and the associated term "segment length" refers to the length of a particular segment, and is expressed as the number of paper side layer wefts with which a member of a pair of intrinsic warp binder yarns interweaves within the segment.

The term "float" refers to a yarn which passes over a group of other yarns without interweaving with them; the associated term "float length" refers to the length of a float, expressed as a number indicating the number of yarns passed over.

The term "interlace" refers to a point at which a paper side yarn wraps about a machine side yarn to form a single knuckle, and the associated term "interweave" refers to a locus at which a yarn forms a plurality of knuckles with other yarns along a portion of its length.

BRIEF DESCRIPTION OF THE DRAWINGS

The invention will now be described by way of reference to the drawings, in which.

In each of the cross section views, the cut paper side layer wefts toward the top of the cross section are numbered from 1 upwards, and the cut machine side layer wefts towards the bottom of the cross section are numbered from 11 upwards. The same pattern repeats to both the left and the right of the Figure in each case, so that, for example, in FIG. 1 the next wefts on the right are 1 and 1'.

In each of the weave diagram views, cross sections are shown along all of the warps, for both the paper side layer and the machine side layer separately. The cut paper side layer wefts are again at the top, and the machine side layer wefts are again at the bottom in each set of three warps.

DETAILED DESCRIPTION OF THE FIGURES

Figure 1:
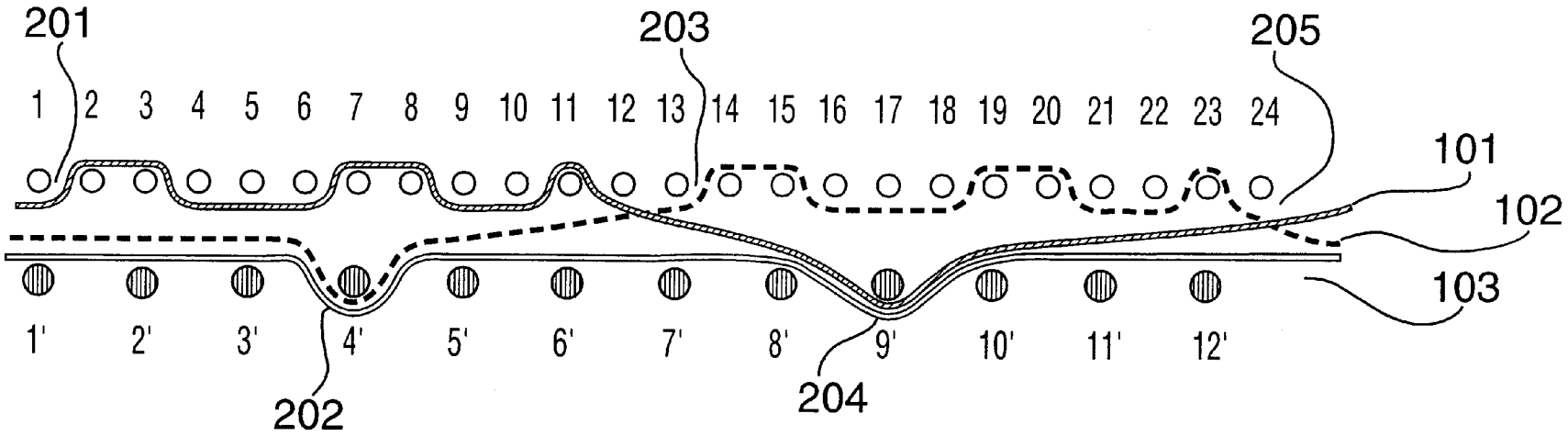
FIG. 1 is a cross sectional view of one embodiment of a composite forming fabric according to the invention showing the paths of one pair of intrinsic warp binder yarns in one repeat of the weave.

FIG. 1 shows a cross section, taken along the line of the warp yarns, illustrating a first embodiment of a composite forming fabric according to the present invention. In FIG. 1, the paper side layer warp yarn pair members are 101 and 102, and the machine side layer warp yarn is 103. The paper side layer is woven in 12 sheds as a 6×12 pattern, which is an alternating plain weave/3-shed twill. The machine side layer is woven in 6 sheds according to a 6×12 design as described by Barrett in U.S. Pat. No. 5,544,678. The composite forming fabric was woven in 18 sheds, 12 for the paper side layer, and 6 for the machine side layer. It is also possible to weave this fabric using 24 sheds, 12 for each of the paper side layer and machine side layer patterns. The paper side layer to machine side layer weft ratio is 2:1. Bearing in mind that each intrinsic warp binder pair is counted as a single yarn, the paper side layer to machine side layer warp ratio is 1:1, and every paper side layer warp comprises a pair of intrinsic warp binder yarns.

Figure 2:
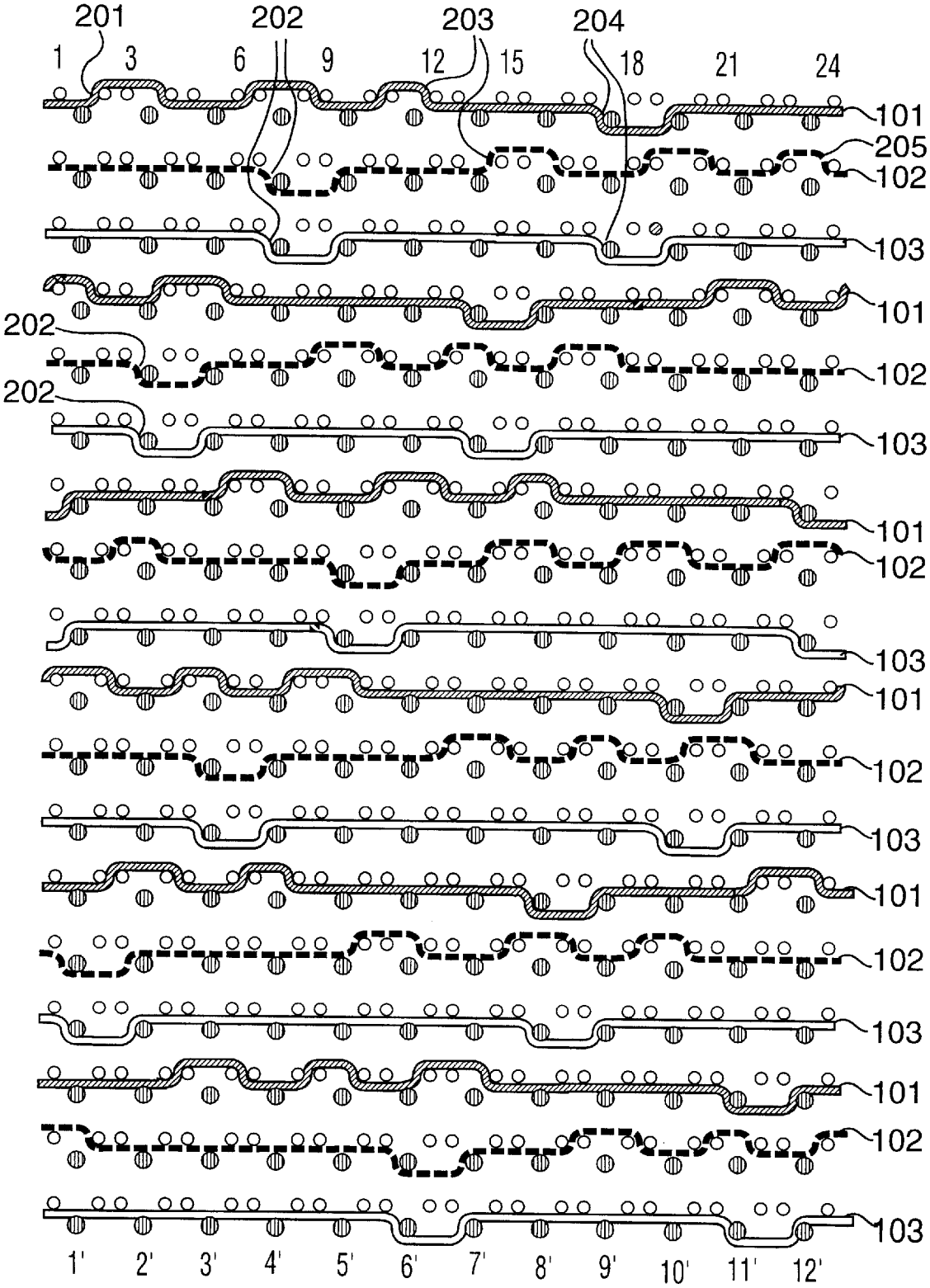
FIG. 2 is a weave diagram of the fabric shown in FIG. 1.

The weave diagram of this fabric is shown in FIG. 2. Starting from the left side of FIG. 1, the first member of the warp yarn pair, 101, rises from the machine side layer and exchanges positions with the second pair member 102 beneath wefts 24 and 1 at 201. Warp 101 then occupies the first segment of the unbroken warp path in the paper side layer weave pattern, passing over wefts 2 and 3, beneath wefts 4, 5 and 6, over wefts 7 and 8, beneath wefts 9 and 10, then over weft 11, to form an alternating plain weave/3-shed twill pattern. Warp 101 then passes beneath weft 12 where it exchanges positions at 203 with weft 102 which now rises to the paper side layer to occupy the second segment of the unbroken weft path, which has the same pattern as the first segment.

Within the second segment, warp 101 passes down into the machine side layer where it interlaces with weft 9' at 204. It will be seen that machine side layer warp 103 also interlaces with weft 9' at the same point. This assists in recessing warp 101 from the wear plane of the fabric, and increases the wear potential of the fabric. Warp 101 then rises to the paper side surface, exchanging positions with weft 102 at 205, and then occupies a repeat first segment. Within the first segment, warp 102 interlaces with machine side layer weft 4' at the same point that machine side layer warp 202 interlaces with weft 4'. In this embodiment, each member of the paper side layer intrinsic warp yarn pairs interlaces once with a machine side layer weft yarn in every 24 paper side layer weft yarns.

Two features of the composite fabrics of this invention are visible in this cross section. Although the two segment lengths are the same, the weave pattern of the two intrinsic warp binder yarns is not the same. In the first segment, intrinsic warp 101 interlaces with weft 4', but in the second segment, intrinsic warp 102 interlaces with weft 9', not with weft 10': the interlacing point is moved by one weft. This difference occurs as a function of the uneven float lengths of 4 and 6 within the machine side layer provided by the Barrett style weave used for it. Also, in the paper side layer weave pattern the two segments are the same length—from weft 2 to weft 11, and from weft 14 to weft 23 in each case—and are separated at each end by two wefts, e.g. 12 and 13 at 203.

In FIG. 2 a weave diagram is provided of the fabric whose cross section is shown in FIG. 1. In this diagram, the paths of all of the warps making up the fabric pattern repeat are shown. The paper side layer wefts are numbered at the top of the Figure, and the machine side layer wefts are numbered at the bottom.

The top three lines are exemplary. In the first line, intrinsic binder warp yarn 101 occupies the first segment in the paper side layer between wefts 2 and 11, and intrinsic binder warp yarn 102 occupies the second segment, between wefts 14 and 23. There are thus two wefts inbetween each segment. This recurs through the weave diagram. Each intrinsic binder warp interlaces once with a machine side layer weft within each segment, and a machine side layer warp interlaces the same weft at that point, as indicated at 202 and 204. This common interlacing point also persists though the weave diagram, and moves by two machine side layer weft (which is equivalent to four paper side layer weft) to the left for each set of three warps: e.g. the interlacing point moves from weft 4' to weft 2'.

It is a characteristic of the fabrics of this invention that the paper side layer weave design must "fit" onto the independent weave structure of the machine side layer. There are two reasons for this. First, the locations at which the paper side layer warp yarns interlace with the machine side layer weft yarns, binding the two structures together, must coincide with the interlacing locations of the machine side layer warp and weft yarns. The weave structures of each fabric layer must therefore be such that this may occur without causing any undue deformation of the paper side surface. Interlacing each paper side layer warp yarn with one machine side layer weft yarn at the same point that a machine side layer warp yarn interlaces with the same weft assists in recessing the paper side layer warp yarn as far as possible from the exposed machine side surface, known as the wear plane, of the machine side layer, so as to increase fabric wear life. Second, the paper side layer and machine side layer weaves should fit such that the locations at which each of the intrinsic binder warp yarns interlace with the machine side layer wefts can be as far removed as possible from the segment ends within the paper side layer weave pattern. This will reduce or minimize dimpling and any other surface imperfections caused by bringing the paper side layer intrinsic binder warp down into the machine side layer.

Inspection of FIGS. 1 and 2 shows that:

- in the first segment, the interlacing point 202 is almost at the middle of the segment underneath weft 7,
- in the second segment, the interlacing point is somewhat offset from the middle of the segment underneath weft 17, and
- in both segments there are at least three paper side layer wefts between a segment end and the interlacing points 202 and 204.

A fabric sample was woven according to the design shown in FIG. 1, using standard round polyester warp and weft yarns. In this fabric sample, the diameter of the paper side layer warp yarns was 0.13 mm, the machine side layer warp yarn diameter was 0.21 mm, the paper side layer weft yarn diameter was 0.14 mm, and the machine side layer weft yarn diameter was 0.30 mm. Selection of an appropriate weft yarn size will depend on the desired knocking, or number of weft yarns per unit length in the fabric and will affect the air permeability of the resulting fabric. The air permeabilities cited for both this fabric and those discussed below were measured according to ASTM D 737-96, using a High Pressure Differential Air Permeability Machine, available from The Frazier Precison Instrument Company, Gaithersburg, Md., USA, and with a pressure differential of 127 Pa through the fabric; the air permeability is measured on the fabric after heat setting. The open surface areas cited for both this fabric and those discussed below were measured according to CPPA Data Sheet G-18; the open surface area is measured on the fabric after heat setting.

After heat setting, this fabric had a paper side layer mesh count per cm of 28.7×27.6 (warp×weft), a machine side layer mesh count per cm of 28.7×13.8, an open area of 47.6%, a warp fill after heat setting of 135%, and an air permeability of about 6,420 $m^3/m^2/hr$. The air permeability of this fabric can be reduced to from about 5,360 $m^3/m^2/hr$ to about 5,690 $m^3/m^2/hr$ by suitable choice of the yarn diameters.

Figure 3:
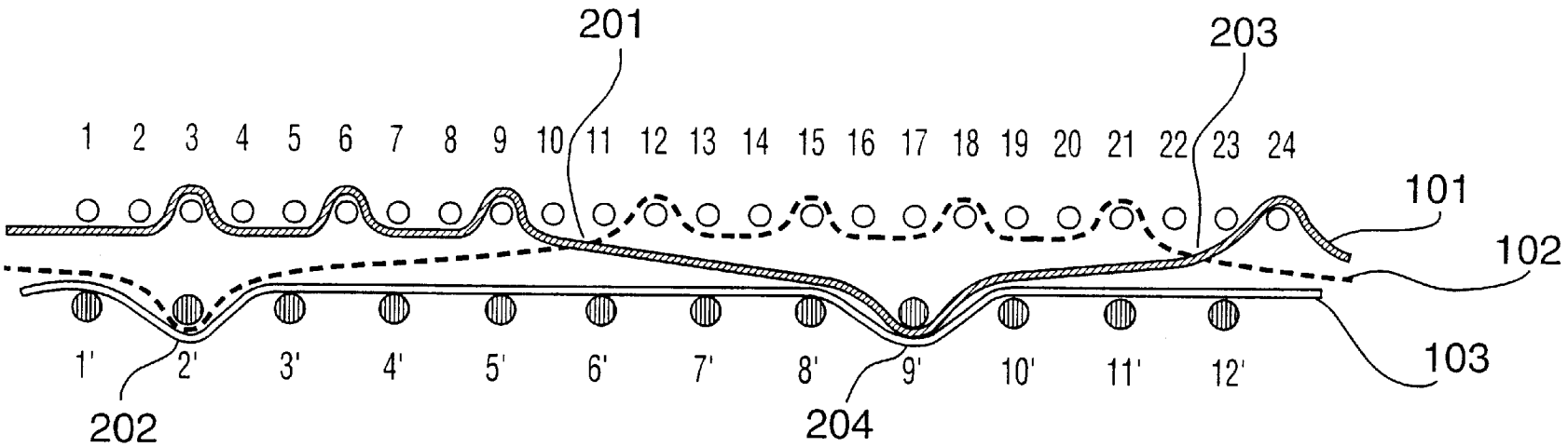
FIG. 3 is a cross sectional view similar to FIG. 1 of a second embodiment of a composite forming fabric according to the invention.
Figure 4:
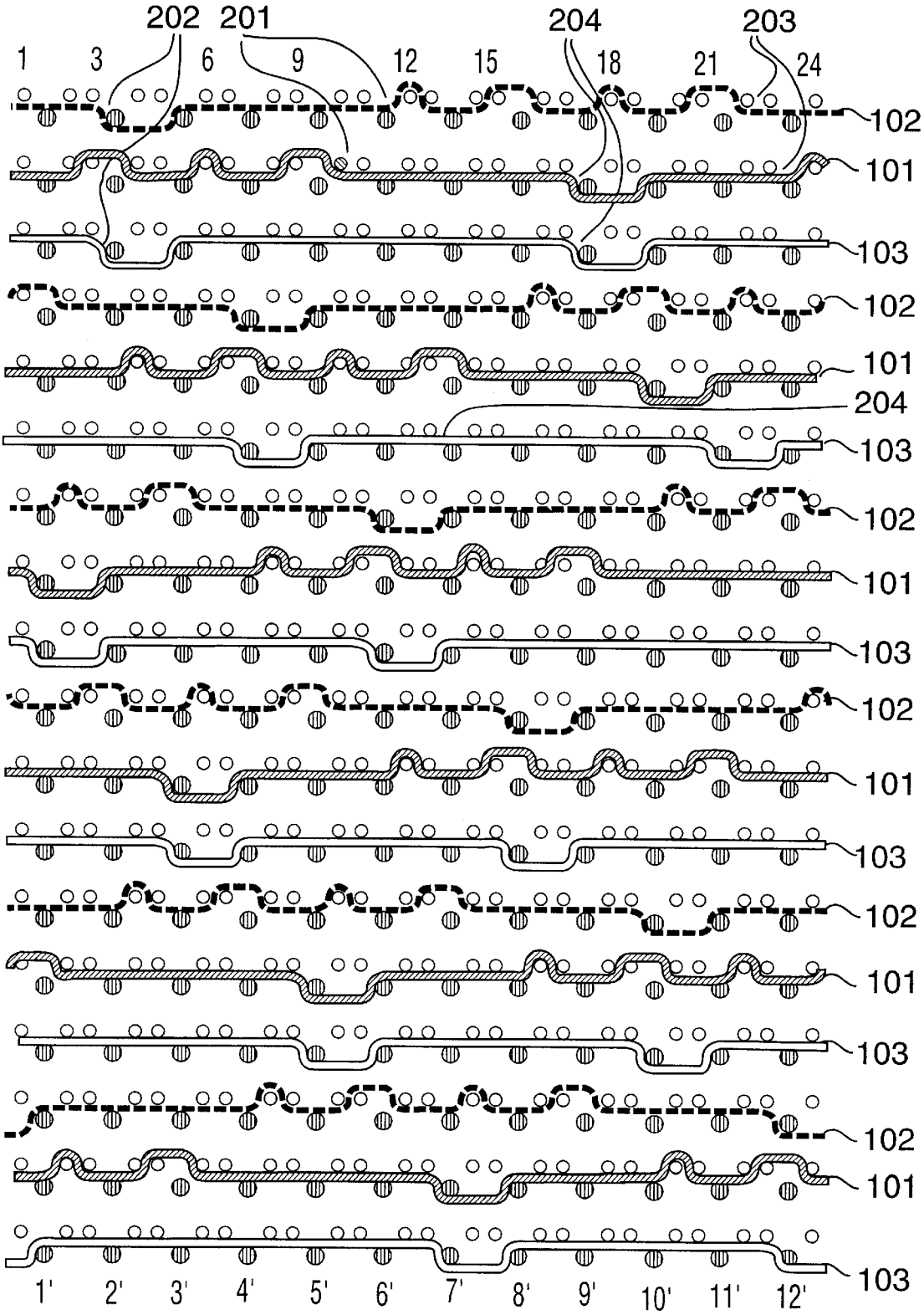
FIG. 4 is a weave diagram of the fabric shown in FIG. 2.

In FIG. 3 there is shown an alternate embodiment of a fabric according to the present invention. The weave pattern of this fabric is shown in FIG. 4. The paper side layer is woven according to a 3-shed, 2×1 twill design, and the machine side layer is woven according to a 6×12 Barrett design. The composite forming fabric may be woven in 18 sheds (12 top, 6 bottom) or 24 sheds (12 each of the top and bottom). In this embodiment, unlike the fabric shown in FIG. 1, the interweaving of the paper side layer warp and weft is regular so that each intrinsic binder warp yarn in each pair passes over one weft and beneath two in each repeat. The two segments are of the same length, and the pair members exchange positions twice in each pattern repeat at 201 and 203. There are two paper side layer wefts between the segments. Due to the asymmetry in the Barrett design used for the machine side layer, the weave pattern in the composite fabric of the two intrinsic warp binder yarns is not the same. The pair members interlace with the machine side layer wefts at 202 and 204; there are 6 machine side layer wefts on the left side of the interlacing point at 204, but only 4 wefts on the right side, between adjacent interlacing points.

The warp and weft yarn sizes used in a fabric sample woven according to the design of FIG. 3 were are the same as those used in the fabric of FIG. 1, at a warp ratio of paper side warp:machine side warp of 1:1, and at a weft ratio of paper side weft:machine side weft of 2:1. If the fabric of FIG. 3 is woven using a 1:1 ratio of the paper side layer and machine side layer weft yarns, it may be desirable to use smaller machine side layer weft, such as 0.22 mm, to assist in decreasing fabric air permeability, while maintaining the mesh count constant. After heat setting, this fabric sample had a paper side mesh count per cm of 28.7×27.6, a machine side mesh count of per cm of 28.7×13.8, an open area of 46.1, a warp fill of 135%, and an air permeability of about 6,500 $m^3/m^2$/hr. Before heat setting the warp fill was found to be 121.7%.

In FIG. 4 a weave diagram similar to that of FIG. 2 is provided of the fabric whose cross section is shown in FIG. 3.

The top three lines again are exemplary. In the first line, intrinsic binder warp yarn 102 occupies the second segment in the paper side layer between wefts 12 and 21. In the second line, intrinsic binder warp yarn 101 occupies the first segment, between wefts 24 and 9. There are thus two wefts inbetween each of the segments. This persists through the weave diagram, moving four paper side layer weft to the right for each set of three warps. Each intrinsic binder warp interlaces once with a machine side layer weft within each segment, and a machine side layer warp interlaces the same weft at that point, as indicated at 202 and 204. This common interlacing point also persists though the weave diagram, and moves by two machine side layer weft (which is equivalent to four paper side layer weft) to the right for each set of three warps.

Figure 5:
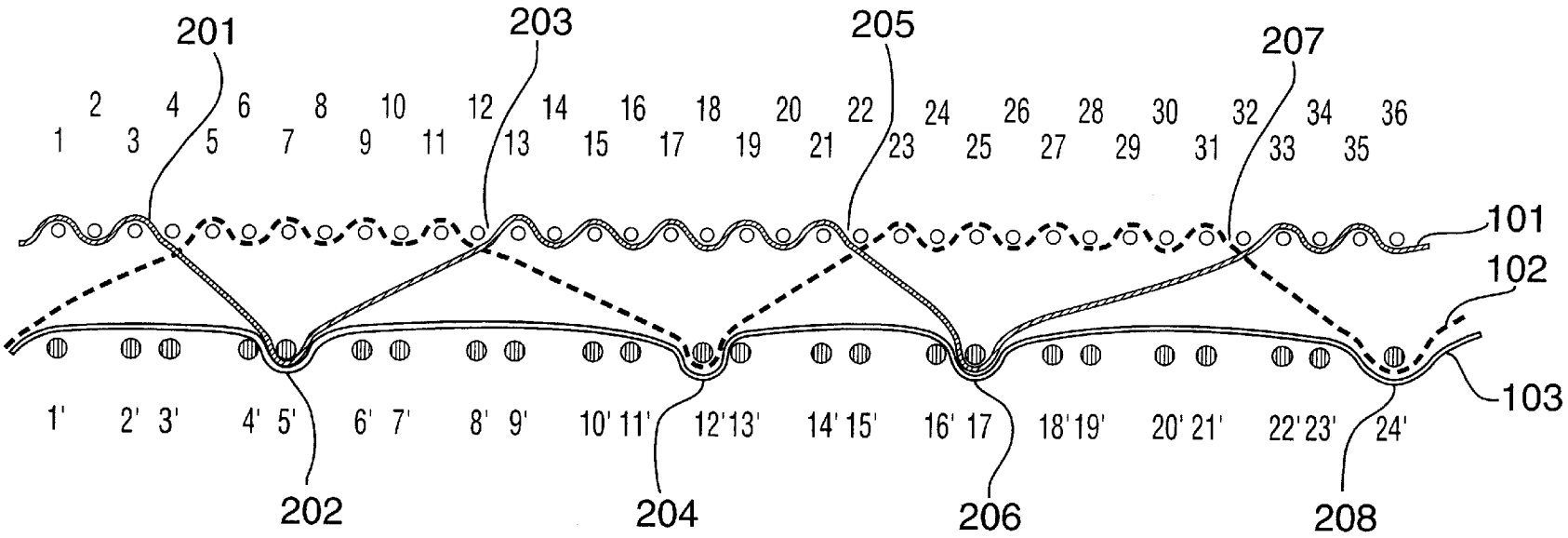
FIG. 5 is a cross sectional view similar to FIG. 1 of a third embodiment of a composite forming fabric according to the invention.
Figure 6:
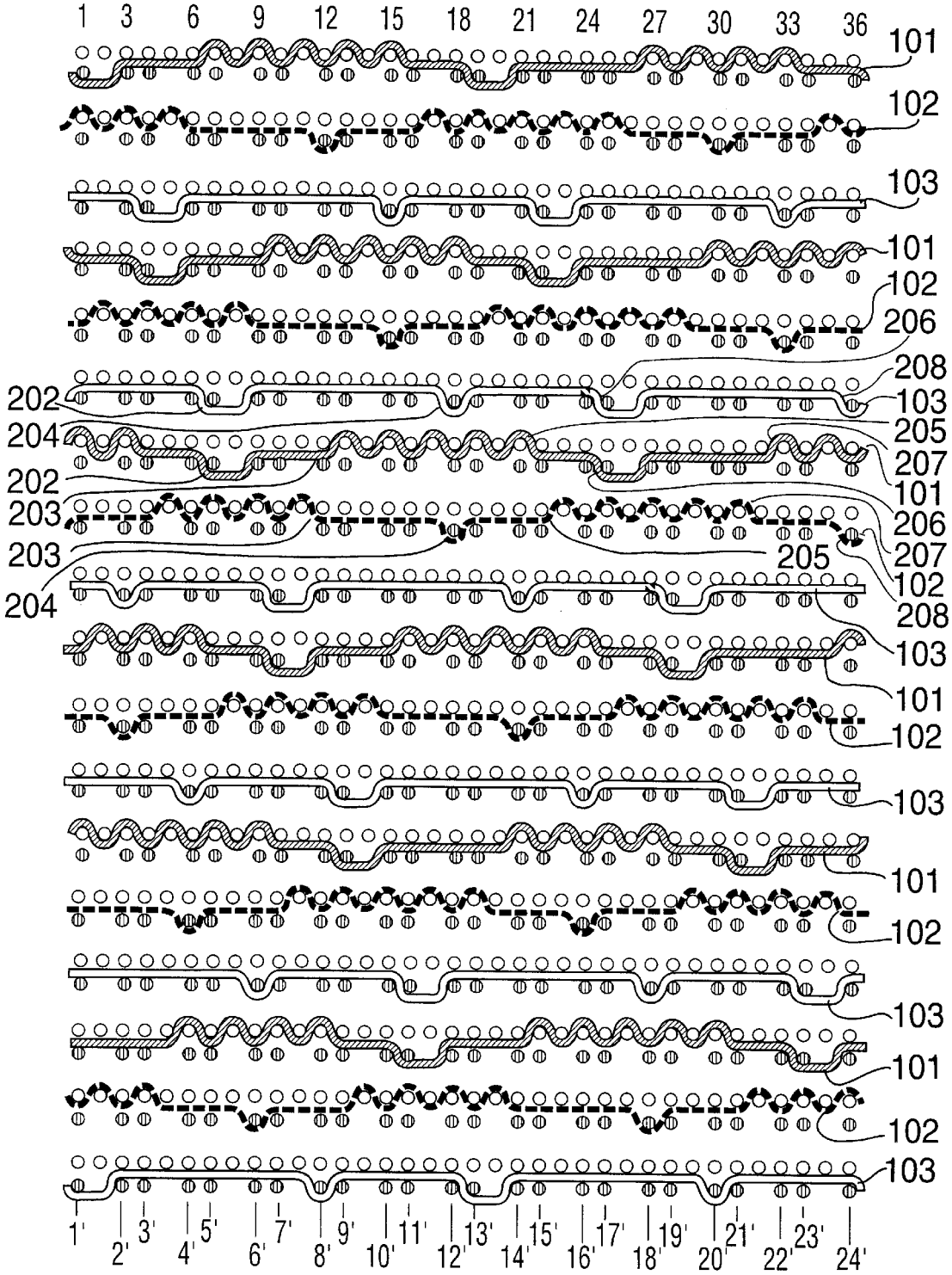
FIG. 6 is a weave diagram of the fabric shown in FIG. 5.

FIG. 5 shows a more complex embodiment of the present invention. The weave diagram of the fabric is shown in FIG. 6. In this embodiment, the paper side layer is woven according to a 1×1 plain weave pattern in 12 sheds, while the machine side layer is woven according to a 6×12 Barrett design in 6 sheds. The composite fabric is woven using 18 sheds. The weft ratio is 3:2, and the warp ratio is 1:1.

In this embodiment, the machine side layer warp 103 interlaces with four machine side layer wefts 5', 12', 17' and 24' at 202, 204, 206 and 208 within the pattern repeat. This embodiment also requires four segments, which are not all the same length. In the first segment, intrinsic warp binder yarn 101 interlaces with machine side layer weft 5' at 202; in the second segment, intrinsic warp binder yarn 102 interlaces with machine side layer weft 12' at 204; in the third segment intrinsic warp binder yarn 101 interlaces with machine side layer weft 17' at 206; and in the fourth segment intrinsic binder warp yarn 102 interlaces with weft 24' at 208. Inspection of the paper side layer weave shows that the segments are all separated by a single weft, and that the segment lengths are as follows: first segment, 7; second segment, 9; third segment 9; and the fourth segment 7, for a total of 32 wefts, plus four single wefts. Thus in this fabric both the segment lengths, and the warp binder yarn paths within the composite fabric, are not the same.

Two sample fabrics were woven according to the design of FIG. 5, using the following combinations of yarn sizes and mesh counts.

TABLE 2

| | Fabric A | Fabric B. |
|---|---|---|
| PSL Warp, diameter | 0.13 mm | 0.13 mm |
| PSL Weft, diameter | 0.13 mm | 0.15 mm |
| PSL Mesh Count, cm | 28.7 × 23.6 | 28.7 × 23.6 |
| MSL Warp, diameter | 0.21 mm | 0.21 mm |
| MSL Weft, diameter | 0.30 mm | 0.35 mm |
| Air Permeability | 6,012 | 6,012 |
| Open Surface Area | 43.4% | 40.4% |
| Warp Fill A | 135% | 135% |
| Warp Fill B | 122% | 122% |

In Table 2, PSL refers to paper side layer, and MSL to machine side layer, and the air permeability is in $m^3/m^2$/hr. The mesh counts, air permeabilities, open surface areas, and warp fills A were all measured after heat setting of the fabric; warp fill B was measured before heat setting.

In FIG. 6 a weave diagram similar to that of FIG. 2 is provided of the fabric whose cross section is shown in FIG. 5. In this Figure the warp path sequence is not in the same order as the sequence in FIGS. 2 and 4, as the machine side layer warp yarn path 103 is shown above the intrinsic warp binder yarn paths 101 and 102, rather than below. The cross section shown in FIG. 5 corresponds to lines 6, 7 and 8 in FIG. 6, which are numbered to correlate with FIG. 5.

In the third numbered line, intrinsic binder warp yarn 102 occupies the second segment in the paper side layer between wefts 5 and 11, and also occupies the fourth segment between wefts 23 and 31. In the second numbered line, intrinsic binder warp yarn 101 occupies the end of the first segment up to weft 3, the third segment between wefts 13 and 21, and the beginning of the next first segment starting at weft 33 up to weft 36. There is one weft in between each of the four segments. This persists through the weave diagram, moving four paper side layer weft to the right for each set of three warps. Each intrinsic binder warp interlaces once with a machine side layer weft within each segment, and a machine side layer warp interlaces the same weft at that point, as indicated at 202, 204, 206 and 208. This common interlacing point also persists though the weave diagram, and moves by two machine side layer weft (which is equivalent to four paper side layer weft) to the right for each set of three warps.

FIG. 6 also serves to illustrate a unique feature of the fabrics of the present invention when compared to known prior art intrinsic warp designs. It can be seen from FIG. 6 that every machine side layer warp knuckle comprises an interlacing between a machine side layer weft yarn and both a machine side layer warp yarn and a paper side layer intrinsic warp binder yarn.

What is claimed is:

1. A composite forming fabric comprising in combination a paper side layer having a paper side surface, a machine side layer, and paper side layer intrinsic warp binder yarns which bind together the paper side layer and the machine side layer, wherein:

(i) the paper side layer and the machine side layer each comprise warp yarns and weft yarns woven together in a repeating pattern, and the paper side layer and the machine side layer together are woven in at least 6 sheds;

(ii) in the paper side layer all of the warp yarns comprise pairs of intrinsic warp binder yarns;

(iii) in the paper side surface of the paper side layer the repeating pattern provides an unbroken warp yarn path in which the paper side layer warp yarn floats over 1, 2 or 3 consecutive paper side layer weft yarns;

(iv) each of the pairs of intrinsic warp binder yarns occupy the unbroken warp path in the paper side layer;

(v) the ratio of paper side layer weft yarns to machine side layer weft yarns is chosen from 1:1, 2:1, 3:2, and 3:1; and (vi) the ratio of paper side layer warp yarns to machine side layer warp yarns is chosen from 1:1 to 3:1; and wherein the pairs of intrinsic warp binder yarns comprising all of the paper side layer warp yarns are woven such that:

(a) in a first segment of the unbroken warp path:

(1) the first member of the pair interweaves with a first group of paper side layer wefts to occupy a first part of the unbroken warp path in the paper side surface of the paper side layer;

(2) the first member of the pair floats over 1, 2 or 3 consecutive paper side layer weft yarns; and (3) the second member of the pair interlaces with one weft yarn in the machine side layer beside a machine side layer warp yarn that interlaces with the same machine side layer weft yarn;

(b) in an immediately following second segment of the unbroken warp path:

(1) the second member of the pair interweaves with a second group of paper side layer wefts to occupy a second part of the unbroken warp path in the paper side surface of the paper side layer;

(2) the second member of the pair floats over 1, 2 or 3 consecutive paper side layer weft yarns; and (3) the first member of the pair interlaces with one weft yarn in the machine side layer beside a machine side layer warp yarn that interlaces with the same machine side layer weft yarn;

(c) the first and second segments are of equal or unequal length;

(d) the unbroken warp path in the paper side surface of the paper side layer occupied in turn by the first and the second member of each pair of intrinsic warp binder yarns in the paper side layer has a single repeat pattern;

(e) in the unbroken warp path in the paper side surface of the paper side layer occupied in turn by the first and second members of each pair of intrinsic warp binder yarns, each succeeding segment is separated in the paper side surface of the paper side layer by at least one paper side layer weft yarn;

(f) in the paper side layer the unbroken warp path includes at least two segments; and (g) in the composite fabric the weave pattern of the first member of a pair of intrinsic warp binder yarns is the same, or different, to the weave pattern of the second member of the pair.

2. A fabric according to claim 1 wherein the paper side layer unbroken warp path includes two segments, and each segment occurs once within each complete repeat of the composite forming fabric weave pattern.

3. A fabric according to claim 1 wherein the paper side layer unbroken warp path includes four segments, and each segment occurs twice within each complete repeat of the composite forming fabric weave pattern.

4. A fabric according to claim 1 wherein in the paper side layer unbroken warp path each segment is separated from the next segment by either 1, 2 or 3 paper side layer weft yarns.

5. A fabric according to claim 4 wherein in the paper side layer unbroken warp path each segment is separated from the next segment by 1 or 2 paper side layer weft yarns.

6. A fabric according to claim 5 wherein in the paper side layer unbroken warp path each segment is separated from the next segment by 1 paper side layer weft yarn.

7. A fabric according to claim 5 wherein in the paper side layer unbroken warp path each segment is separated from the next segment by 2 paper side layer weft yarns.

8. A fabric according to claim 1 wherein within the paper side layer weave pattern, the segment lengths of the paths of each of a pair of intrinsic warp binder yarns occupying the unbroken warp path are identical.

9. A fabric according to claim 1 wherein within the paper side layer weave pattern, the segment lengths of the paths of each of a pair of intrinsic warp binder yarns occupying the unbroken warp path are not identical.

10. A fabric according to claim 1 wherein within the composite fabric weave pattern the paths occupied by each of a pair of paper side layer intrinsic warp binder yarns are the same, and the interlacing points between the intrinsic warp binder yarns with the machine side layer wefts are regularly spaced, and are the same distance apart.

11. A fabric according to claim 1 wherein within the composite fabric weave pattern the paths occupied by each of a pair of paper side layer intrinsic warp binder yarns are the not same, and the interlacing points between the intrinsic warp binder yarns with the machine side layer wefts are not regularly spaced, and are not the same distance apart.

12. A fabric according to claim 1 wherein within the composite fabric the weave design is chosen such that:

(1) the segment lengths in the paper side layer are the same, and the interlacing points between the intrinsic warp binder yarns with the machine side layer wefts are regularly spaced;

(2) the segment lengths in the paper side layer are the same, and the interlacing points between the intrinsic warp binder yarns with the machine side layer wefts are not regularly spaced, and are not the same distance apart;

(3) the segment lengths in the paper side layer are not the same, and the interlacing points between the intrinsic warp binder yarns with the machine side layer wefts are not regularly spaced, and are not the same distance apart.

13. A fabric according to claim 1 wherein the paper side layer weave pattern is chosen from the group consisting of a plain 1×1 weave; a 1×2 weave; a 1×3 weave; a 1×4 weave; a 2×2 basket weave; a 3×6 weave; a 4×8 weave; a 5×10 weave; and a 6×12 weave.

14. A fabric according to claim 1 wherein the weave design of the machine side layer is chosen from an unsymmetrical N×2N design, a satin and a twill design.

15. A fabric according to claim 1 wherein the ratio of the number of paper side layer weft yarns to machine side layer weft yarns in the composite forming fabric is chosen from the group consisting of 1:1, 2:1, 3:2 or 3:1.

16. A fabric according to claim 1 wherein the ratio of paper side layer warp yarns to machine side layer warp yarns is either 1:1, 2:1 or 3:1.

17. A fabric according to claim 1 wherein the ratio of paper side layer weft yarns to machine side layer weft yarns is 2:1.

18. A fabric according to claim 1 wherein the ratio of paper side layer weft yarns to machine side layer weft yarns is 3:2.

19. A fabric according to claim 1 wherein the ratio of paper side layer warp yarns to machine side layer warp yarns is 1:1.

20. A fabric according to claim 1 wherein the yarn diameters are chosen to provide after heat setting an air permeability when measured by a standard test procedure of from about 3,500 $m^3/m^2/hr$ to about 8,200 $m^3/m^2/hr$, and a paper side layer paper side surface open area when measured by a standard test procedure of at least about 35%.

21. A fabric according to claim 1 having before heat setting a warp fill of from about 100% to about 125%.

22. A fabric according to claim 1 having after heat setting a warp fill of from about 110% to about 140%.

23. A fabric according to claim 1 wherein the yarn diameters are chosen to provide after heat setting an air permeability when measured by a standard test procedure of from about 3,500 $m^3/m^2/hr$ to about 8,200 $m^3/m^2/hr$, a paper side layer paper side surface open area when measured by a standard test procedure of at least about 35%, and a warp fill before heat setting of from about 100% to about 125%.

24. A fabric according to claim 1 wherein the yarn diameters are chosen to provide after heat setting an air permeability when measured by a standard test procedure of from about 3,500 $m^3/m^2/hr$ to about 8,200 $m^3/m^2/hr$, a paper side layer paper side surface open area when measured by a standard test procedure of at least about 35%, and a warp fill after heat setting of from about 110% to about 140%.

* * * * *

UNITED STATES PATENT AND TRADEMARK OFFICE

CERTIFICATE OF CORRECTION

PATENT NO. : 6,202,705 B1
DATED : March 20, 2001
INVENTOR(S) : Dale B. Johnson et al.

It is certified that error appears in the above-identified patent and that said Letters Patent is hereby corrected as shown below:

Title page,
Item [57], in the ABSTRACT, line 26, delete -- The fabrics are thus particularly suitable for the formation of paper products having very low micro density differences, which provides enhanced printability. --.

Column 4,
Lines 50 and 51, replace "of equal or unequal length" with -- each of a predetermined length --; and
Lines 64-67, replace section (g) of the claim, with -- (g) in the composite fabric the first member and the second member of the pair of intrinsic warp binder yarns are each woven to a predetermined weave pattern. --.

Column 13, claim 1,
Lines 32 and 33, section (c), replace "of equal or unequal length" with -- each of a predetermined length --; and
Lines 46-49, replace section (g) of the claim, with -- (g) in the composite fabric the first member and the second member of the pair of intrinsic warp binder yarns are each woven to a predetermined weave pattern. --.

Column 14, claim 8,
Line 5, insert, -- predetermined --, before "segment"; and replace all writing after "lengths" with -- of each of the first and second segments are of equal length. --; and Claim 9,
Line 9, insert -- predetermined --, before "segment"; and replace all writing after "lengths" with -- of each of the first and second segments are not of equal length. --; and

UNITED STATES PATENT AND TRADEMARK OFFICE

CERTIFICATE OF CORRECTION

PATENT NO. : 6,202,705 B1
DATED : March 20, 2001
INVENTOR(S) : Dale B. Johnson et al.

It is certified that error appears in the above-identified patent and that said Letters Patent is hereby corrected as shown below:

Claim 12,
Line 25, delete "such that" and insert, -- from the group consisting --, after "chosen"; replace the reference numerals "(1), (2), and (3)" with -- (A), (B), and (C) -- respectively.

Signed and Sealed this

Twelfth Day of March, 2002

*Attest:*

*Attesting Officer*

JAMES E. ROGAN
*Director of the United States Patent and Trademark Office*